US008647606B1

(12) United States Patent
Postlewaite

(10) Patent No.: US 8,647,606 B1
(45) Date of Patent: Feb. 11, 2014

(54) DEVICE AND METHOD FOR TREATING THE ORAL CAVITY

(76) Inventor: Laura M. Postlewaite, New Albany, OH (US)

( * ) Notice: Subject to any disclaimer, the term of this patent is extended or adjusted under 35 U.S.C. 154(b) by 0 days.

(21) Appl. No.: 13/158,024

(22) Filed: Jun. 10, 2011

Related U.S. Application Data

(63) Continuation of application No. 12/576,771, filed on Oct. 9, 2009, now Pat. No. 7,959,902, which is a continuation of application No. 10/946,220, filed on Sep. 21, 2004, now abandoned.

(51) Int. Cl.
*A61K 8/00* (2006.01)

(52) U.S. Cl.
USPC ..... 424/49; 132/308

(58) Field of Classification Search
None
See application file for complete search history.

(56) References Cited

U.S. PATENT DOCUMENTS 3,905,113 A * 9/1975 Jacob ..... 433/216
4,617,694 A * 10/1986 Bori ..... 15/167.1
4,679,274 A * 7/1987 Friedman ..... 15/167.1
5,213,428 A * 5/1993 Salman ..... 401/7
5,547,465 A * 8/1996 Powell ..... 602/54
5,678,273 A * 10/1997 Porcelli ..... 15/104.94
D492,117 S * 6/2004 Sarkar et al. ..... D4/103
7,959,902 B1 * 6/2011 Postlewaite ..... 424/49
2004/0101494 A1 * 5/2004 Scott et al. ..... 424/49
2004/0202698 A1 * 10/2004 Ramji et al. ..... 424/443
2004/0258457 A1 * 12/2004 Legendre ..... 401/205

* cited by examiner

*Primary Examiner* — David J Blanchard
*Assistant Examiner* — Daniel F Coughlin
(74) *Attorney, Agent, or Firm* — Standley Law Group LLP

(57) ABSTRACT

A device that may be placed on a fingertip for treating an oral cavity. The device may be made from a material comprised of at least one ingredient for treating an oral cavity. Examples of ingredients for treating an oral cavity include abrasives, cavity prevention ingredients, medicinal ingredients (e.g., antiseptics, fungicides, and anesthetics), odor absorbing ingredients, tartar control ingredients, plaque control ingredients, tooth whitening ingredients, ingredients adapted to provide relief from hypersensitivity, and other cleaning ingredients and dentifrices. The device may be dissolvable and edible. Furthermore, some or all of the ingredients may be digestible. For example, the device may be primarily or entirely made of ingredients that are digestible.

17 Claims, 4 Drawing Sheets

DEVICE AND METHOD FOR TREATING THE ORAL CAVITY

CROSS-REFERENCE TO RELATED APPLICATIONS

This application is a continuation of U.S. application Ser. No. 12/576,771 filed on 9 Oct. 2009 now issued U.S. Pat. No. 7,959,902, which in turn is a continuation of U.S. application Ser. No. 10/946,220 filed on 21 Sep. 2004, now abandoned.

BACKGROUND AND SUMMARY OF THE INVENTION

The present invention relates generally to a device and method for treating the oral cavity (e.g., teeth, gums, tongue, and/or mouth). Treatment of the oral cavity may include brushing or rubbing the teeth in order to physically remove food, tarter, plaque, microorganisms (e.g., bacteria, fungi, and germs), or other undesired items. Treatment may also include the use of a medicinal ingredient (e.g., an antiseptic or fungicide) to kill bacteria, fungi, germs, and other microorganisms such as those that may cause tooth decay, bad breath odor, or gum disease. Furthermore, treatment may also include providing relief from symptoms of the oral cavity, whitening the teeth, preventing cavities, absorbing odors, controlling tartar and plaque, or otherwise cleaning the oral cavity.

There are many different known ways to clean the oral cavity. For example, toothpicks, floss, mouthwash, oral medicine, and mints in various forms are also commonly used to clean the oral cavity. A traditional way of cleaning the oral cavity also includes brushing the teeth using a toothbrush and toothpaste. Toothbrushes may be permanent, disposable, or biodegradable. For instance, disposable toothbrushes are provided by U.S. Pat. Nos. 5,107,562; 5,213,428; 5,794,774; 5,909,739; 6,004,059; and 6,105,587. Such devices may be bulky, inconvenient to transport or use, or difficult to package in large quantities for frequent uses. In addition, such devices may at least temporarily result in trash or debris that should be discarded in an appropriate manner. U.S. Pat. No. 4,292,705 discloses a tongue toothbrush that may be reusable, disposable, or edible. However, this device suffers from the same shortcomings as the foregoing devices. Furthermore, it is difficult as well inconvenient to brush teeth using a toothbrush that is placed on the tongue as taught by the patent. In addition, placing the toothbrush on the tongue as taught by the patent would accelerate its deterioration if it is made from an edible material, thereby limiting its effectiveness.

In light of the aforementioned shortcomings, there is a need for a device that may be easily placed on a finger for treating the oral cavity such as by brushing. Another need exists for a device for treating the oral cavity that may be easily and conveniently packaged, particularly in multiple quantities. A need also exists for a device for treating the oral cavity that may be easily and conveniently transported while not in use, particularly in multiple quantities. Furthermore, a need exists for a device for treating the oral cavity which may be placed on a finger and is dissolvable and edible.

The present invention may satisfy one or more of the aforementioned needs. An exemplary embodiment of the present invention is a device that may be placed on a fingertip for treating an oral cavity. The device may be made from a material (e.g., a composition) comprised of at least one ingredient for treating an oral cavity. Examples of ingredients for treating an oral cavity include, but are not limited to, abrasives, cavity prevention ingredients, medicinal ingredients (e.g., antiseptics, fungicides, and anesthetics), odor absorbing ingredients, tartar control ingredients, plaque control ingredients, tooth whitening ingredients, ingredients adapted to provide relief from hypersensitivity, and other cleaning ingredients and dentifrices. The device may be dissolvable and edible. Furthermore, some or all of the ingredients may be digestible. In one exemplary embodiment of the present invention, the device may be primarily or entirely made of ingredients that are digestible.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

The present invention is directed to a device for treating an oral cavity, which includes the teeth, tongue, gums, and other portions of the mouth. An exemplary embodiment is adapted to be placed on a fingertip for use. As used herein, a fingertip shall mean a tip of a finger or thumb. An individual may then place the fingertip and device in the mouth in order to treat the oral cavity. Preferably, the device is rubbed or brushed on the portion of the oral cavity to be treated. Nevertheless, it should be recognized that the device may be placed in the oral cavity by other methods not limited to the use of a fingertip. It should also be recognized that some exemplary embodiments of the device may provide treatment simply by being placed in the mouth.

Figure 1:
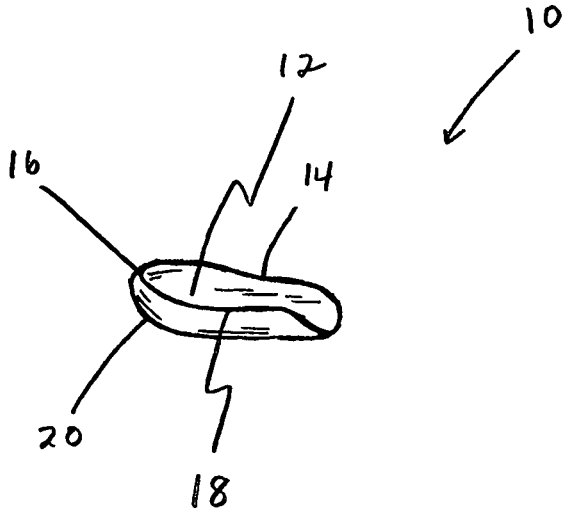
FIG. 1 is a perspective view of an exemplary embodiment of an oral cavity treatment device of the present invention.

FIG. 1 shows an exemplary embodiment of the device of the present invention. The device 10 has a concave portion 12 that is adapted to receive a fingertip. Such as shown in FIG. 1, the device 10 may have an open top so that the fingernail is substantially uncovered. This exemplary embodiment may be beneficial since only one side of the device may typically be used to rub or brush a desired portion of the oral cavity, such as when the teeth, gums, or tongue are being brushed. Consequently, unnecessary cost and materials may be eliminated. Furthermore, this exemplary embodiment would be easier to pack in multiple quantities for transport. Nevertheless, it should be recognized that some embodiments of the present invention may completely enclose the fingertip.

The concave portion 12 may have a rounded surface that approximates the shape of the fingertip to promote a good fit. The rounded surface may curve at least slightly around the fingertip. In other words, side portions 14, 16, and 18 may curve at least slightly upward around the finger, which may result in a desired amount of treatment surface as well as assist in keeping the device on the fingertip during use.

In this exemplary embodiment, the device 10 approximates the size and shape of a fingerprint. For example, the device 10 may be generally oval shaped and about 1 inch by 1.25 inches in order to approximate the size and shape of the portion of the fingertip that provides the fingerprint. Other sizes and shapes of the device 10 are possible and within the scope of the present invention. Therefore, it is not intended to limit the size and shape of the device of the present invention unless expressly stated otherwise.

The convex portion 20 of the device 10 is substantially smooth in this example. However, in other embodiments of the present invention, the convex portion may be rough or have some type of contoured surface. For example, the device may be molded or otherwise formed such that the convex portion has bristles, bumps, or other types of contours.

Figure 2:
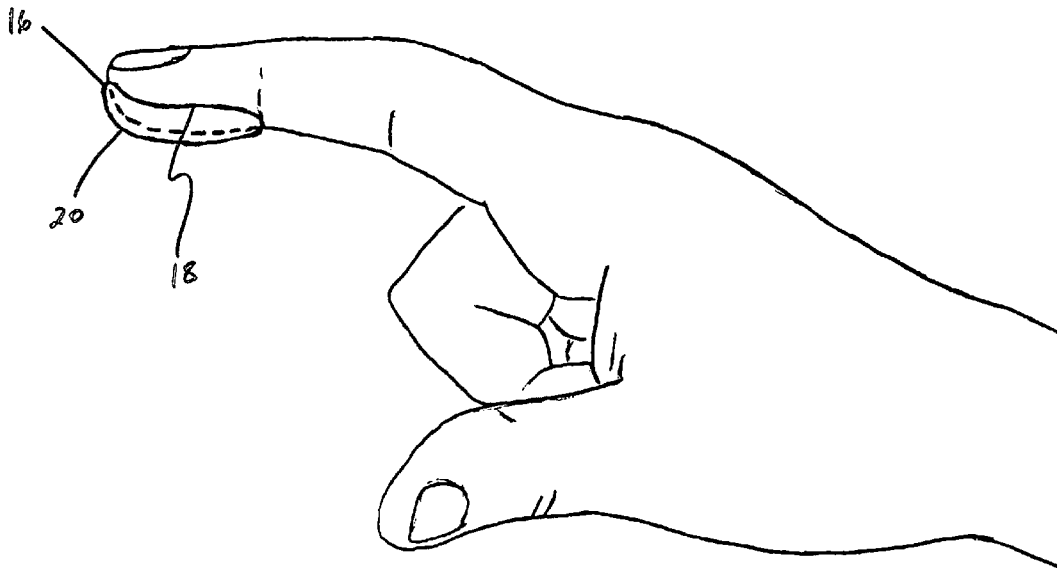
FIG. 2 is a side elevation view of the device of FIG. 1 positioned on a fingertip.
Figure 3:
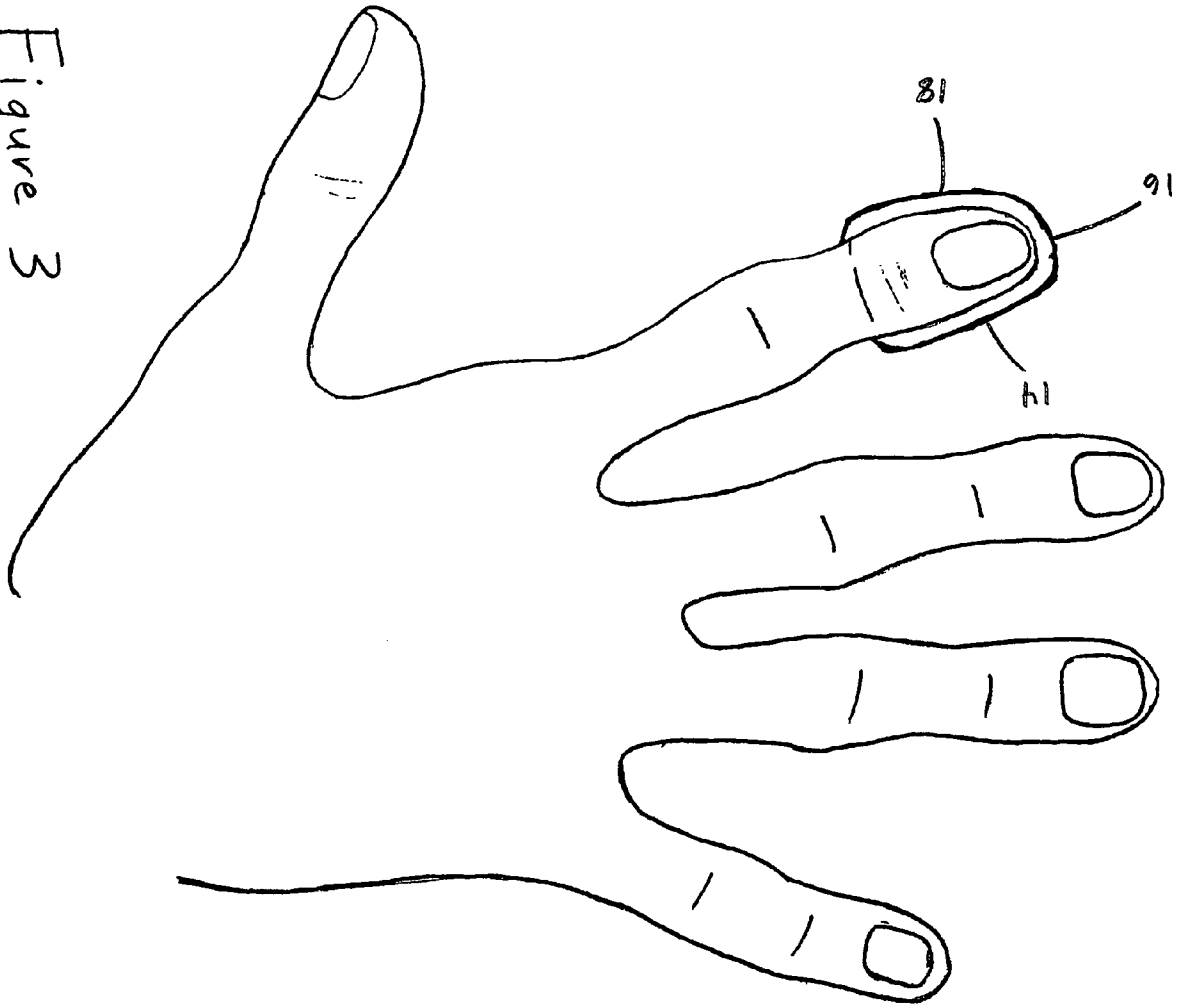
FIG. 3 is a top plan view of the device of FIG. 1 positioned on a fingertip.
Figure 4:
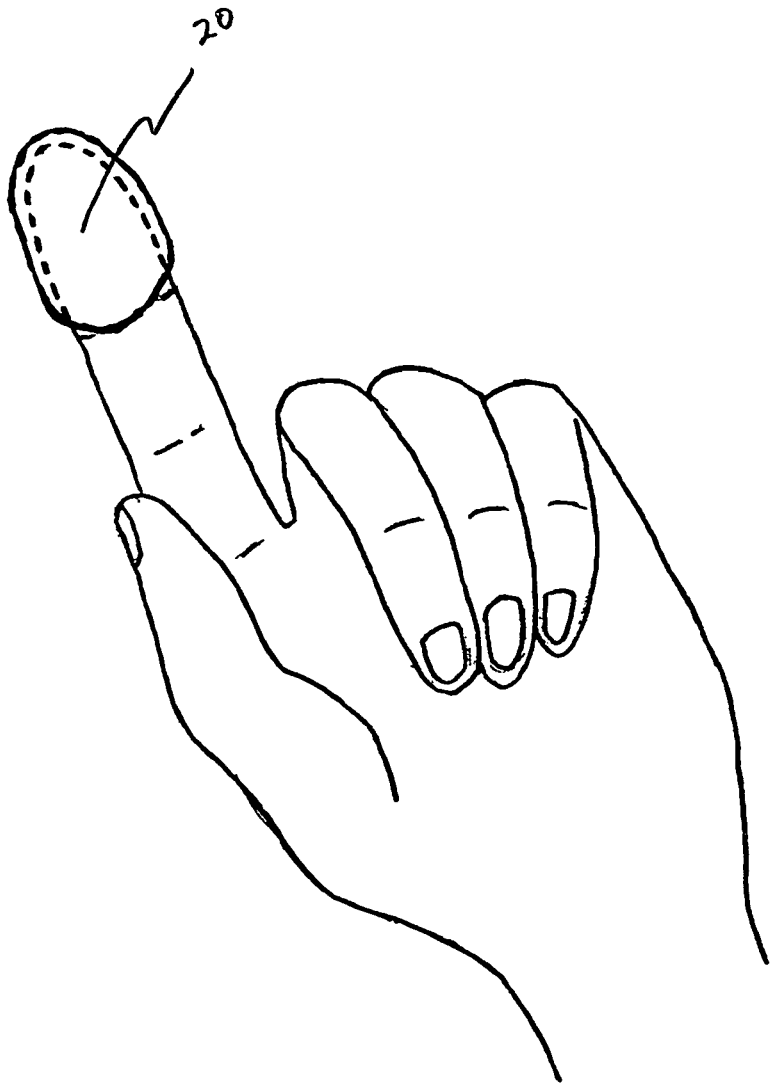
FIG. 4 is a bottom plan view of the device of FIG. 1 positioned on a fingertip.

FIGS. 2 through 4 show the device 10 in use on a fingertip. In this example, the device 10 extends from about the crease of the top knuckle of the finger to about the end of the finger. As can be seen, the device 10 approximates the shape of the fingertip, and the side portions 14, 16, and 18 curve slightly upward around the fingertip. Natural moisture from the fingertip may facilitate keeping the device 10 in a desired position on the fingertip. The fingertip may also be wetted if desired to facilitate keeping the device 10 in a desired position. It should also be recognized that an adhesive (e.g., a pressure sensitive adhesive or any other suitable adhesive) may be coated on the device 10 to promote adherence to a fingertip.

The device 10 may be made from a material that is suitable for the intended use. For example, the device 10 may be comprised of plastic or any other synthetic material if the intended use is to physically remove plaque, tartar, food, or other undesired items from the teeth or other portions of the oral cavity. However, an exemplary embodiment of the device 10 may be dissolvable and edible. In fact, in an exemplary embodiment of the invention, it is preferred that the device 10 is primarily or entirely composed of digestible ingredients. Another example of the device 10 may be made from a dissolvable and edible coating on a plastic substrate.

In an exemplary embodiment, the material from which the device 10 is made may be comprised of at least one ingredient for treating on oral cavity (e.g., for cleaning an oral cavity). For instance, the device 10 may be made from a composition that is comprised of at least one abrasive, cavity prevention ingredient, medicinal ingredient (e.g., antiseptics, fungicides, and anesthetics), odor absorbing ingredient, tartar control ingredient, plaque control ingredient, tooth whitening ingredient, hypersensitivity relief ingredient, and/or other treatment ingredients including, but not limited to, cleaning ingredients and dentifrices.

An abrasive (e.g., a mild abrasive) for brushing the teeth, tongue, and gums may be particularly useful. Sodium bicarbonate, also known as baking soda, is an example of a suitable abrasive that may assist with the removal of plaque and tartar from the teeth. Hydrated silica is another mild abrasive that may promote a gel-like quality, and it may also help remove plaque and tartar, particularly when combined with calcium carbonate.

Another useful ingredient may be for cavity prevention. Xylitol is a good example of a cavity prevention ingredient that may be swallowed. It is a naturally occurring substance found in plants, fruits, and vegetables that may also help to prevent bacteria from adhering to tooth surfaces. Stevia is another natural product that has anti-plaque properties and thus helps to prevent cavities. Fluoride may be used in some embodiments of the present invention. However, it should be recognized that fluoride may have certain negative health consequences if swallowed.

As mentioned above, medicinal ingredients may be included in the material. Medicinal ingredients include, but are not limited to, antiseptics, fungicides, and anesthetics. Thymol may be used as a fungicide and antiseptic to prevent fungus growth and destroy bacteria. It may also be used as a local anesthetic, cooling agent, and preservative. Menthol is an example of an ingredient that has local anesthetic and counterirritant properties. It may provide short-term relief of minor mouth irritation. Tea tree oil is an example of a natural plant extract that has antibacterial, antifungal, antiseptic, and antiviral properties.

In addition to some medicinal ingredients that kill microorganisms that cause bad breath, other ingredients may be used to absorb odors produced by the mouth. For example, copper gluconate is an ingredient that is adapted to absorb odors in the mouth. Hydrogenated vegetable oil and hydrogenated cottonseed oil also may be used for their odor absorbing properties. Sodium bicarbonate is also an odor absorber as well as an acid neutralizer.

A tartar control ingredient may be useful for those who have a tendency to build tartar. Tetra-potassium pyrophosphate is one example of a tartar control ingredient. It is soluble in water and stable under ordinary conditions.

The device 10 may also include ingredients to assist those who have gumline erosion, abrasion, or recession. Potassium nitrate is an example of an ingredient that may provide relief from hypersensitivity that can be caused by such conditions.

Tooth whitening ingredients may also be used. An example of a tooth whitening ingredient is calcium peroxide.

Other ingredients may be included to give the material desired physical characteristics, flavor, or other characteristics. For example, pullulan, which is produced from starch and soluble in water, may be used to give the material desired adhesion and sticking properties, lubrication, and film forming abilities. Agar is an effective gelling agent derived from vegetable sources that may increase the tensile strength of pullulan. Polysorbate 80, polysorbate 65, and polysorbate 60 are examples of emulsifying agents that are adapted to hold air in a mixture and may help provide a firmer texture for holding a shape upon melting or dissolving. Carrageenan is a purified extract from red seaweed that may be used as a thickener and a stabilizer. Locust bean gum and guar gum are also examples of thickeners. Guar gum thickens without the application of heat, and it is also an emulsifier and stabilizer. Another benefit is that it may decrease cholesterol levels in humans. Locust bean gum may be combined with xanthan, with which it shows viscosity synergy. Xanthan gum may be used as a stabilizer, thickener, suspending agent, and bodying agent or form enhancer. Some of its characteristics include high stabilizing properties, high viscosity at low concentrations, solubility in hot and cold water, high pseudoplasticity, excellent freeze/thaw stability, high resistance to ph and temperature variations, high resistance to enzymatic degradation, low caloric value, and compatibility with thickeners and stabilizers. It may provide good cling, improve texture, impart creamy consistency, enhance mouth-feel, contribute body, bind water, and extend contact time. Cellulose gum is another example of a thickener, and it is also a water gellent. Pectin and gelatin(e) may also be used to help the device hold its form longer. Pectin forms a colloidal solution in water and gels on cooling. It is also an ingestible, soluble fiber. On the other hand, gelatin is a protein product that produces gel. Glyceryl oleate and glycerin(e) are emollients that may help to balance or maintain moisture levels. They may also act to extend the flavor and preserve the product. In addition, propylene glycol is an additive that may be used to absorb extra water and maintain moisture. It may also act as a solvent for food colors and flavors.

Any desired flavor, color, and sweeteners may be used, if desired. FD&C Green No. 3 is just one example of a color additive. Examples of flavors include methyl salicylate (i.e., teaberry oil) and eucalyptol. Methyl salicylate may provide the odor and taste of wintergreen. It is soluble in alcohol and slightly soluble in water. Eucalyptol is created from the oil of eucalyptus. In addition to other properties, menthol and thymol may also provide flavor. Aspartame is an example of sweetening agent that may be used. Potassium acesulfame is another sweetener that may be used. It remains stable in high temperatures, and it is synergistic. It also has good shelf life, is diabetic friendly, and does not promote tooth decay. Glycerin may also be used as a sweetener. Natural flavors from fruits, plants, and roots are other available sweeteners. Stevia is an example of a natural sweetener. It is a non-toxic herb that may be used by people with blood sugar problems.

Various combinations of the aforementioned ingredients may be used to make the device of the present invention. For example, one embodiment of the device may include at least one abrasive and at least one cavity prevention ingredient for brushing teeth and other portions of the oral cavity. Some consumers may prefer an all natural version of the device. One example of an all natural version of the device may be comprised of: natural flavors from fruits, plants, and/or roots; a natural sweetener and cavity preventative such as stevia; carrageenan; tea tree oil; glycerin; and xylitol.

The design of the device 10 may facilitate its packaging so that it may be easily transported when not in use. The package may be any desired size and shape. For example, the package may be of a size sufficient to fit in a wallet, pocket, or purse, if desired. One example of a package is approximately 1.5 inches by 3 inches so that it may be easily stored and transported. The devices could be stacked together in succession, with each device slightly exposing the one underneath it. A thin, gauzy paper or another suitable divider may be used to separate adjacent devices. Multiple quantities of the device may be stored in a relatively small package, if desired. For example, a relatively small package may contain five or more of the devices of the present invention. In light of the ease of packaging and transporting the device, the device may be conveniently used while at work, while at a restaurant, while in a car, while traveling, while camping, or in other circumstances too numerous to mention. In addition, the device may be useful for the military. It should also be recognized that the device may be used by people who have teeth as well as edentulous people. Furthermore, the device may be used to clean the oral cavity of an infant, toddler, young child, senior citizen, handicapped individual, injured individual, pet, or any other person or animal that may need assistance or just a simpler way to treat the oral cavity.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An oral cavity treatment device comprising a singular formed piece of material which is dissolvable in saliva and having a surface adapted to rest on a fingerprint of a user's finger, and having an oral cavity treatment ingredient distributed throughout the singular piece which is released into the oral cavity when placed in contact with saliva.

2. The oral cavity treatment device of claim 1 wherein said first surface is concave and approximates the shape of said finger such that said piece curves at least slightly around said finger.

3. The oral cavity treatment device of claim 1 wherein said second surface of said piece is substantially smooth and convex.

4. The oral cavity treatment device of claim 1 wherein said piece is made from a material comprised of at least one oral cavity treatment ingredient.

5. The oral cavity treatment device of claim 1 wherein said piece is made from a material comprising at least one abrasive ingredient.

6. The oral cavity treatment device of claim 5 wherein said at least one abrasive ingredient is selected from the group consisting of sodium bicarbonate, hydrated silica, and calcium carbonate.

7. The oral cavity treatment device of claim 6 wherein said piece is made from a material comprising at least one cavity prevention ingredient.

8. The oral cavity treatment device of claim 7 wherein said at least one cavity prevention ingredient comprises xylitol.

9. The oral cavity treatment device of claim 1 wherein said piece is made from a material comprising at least one medicinal ingredient.

10. The oral cavity treatment device of claim 1 wherein said piece is made from a material comprising at least one odor absorbing ingredient.

11. The oral cavity treatment device of claim 1 wherein said piece is made from a material comprising at least one tartar control ingredient.

12. The oral cavity treatment device of claim 1 wherein said piece is made from a material comprising at least one ingredient adapted to provide relief from hypersensitivity.

13. The oral cavity treatment device of claim 1 wherein said piece is made from a material comprising at least one tooth whitening ingredient.

14. An oral cavity kit, comprising:

one or more singular formed pieces of material having a concave surface approximating the shape of a user's fingertip, adapted to fit over a fingerprint of a user's finger, and having an oral cavity treatment ingredient distributed throughout the singular piece which is released into the oral cavity when placed in contact with saliva, the material providing adhesion to a user's fingertip when exposed to the moisture on a user's finger; and one or more dividers used to separate adjacent pieces;

wherein the formed pieces are stacked together in succession with the dividers placed between adjacent pieces.

15. The kit of claim 14, wherein each formed piece slightly exposes the formed piece underneath.

16. The kit of claim 14, wherein each formed piece slightly exposes the formed piece overhead.

17. The kit of claim 14, further comprising a package used to house the one or more formed pieces.

* * * * *